US006162331A

United States Patent [19]

Ruf et al.

[11] Patent Number: 6,162,331

[45] Date of Patent: Dec. 19, 2000

[54] APPARATUS AND PROCESS FOR CONTROLLING OR REGULATING A WEB PROPERTY PROFILE

[75] Inventors: Wolfgang Ruf, Herbrechtingen-Bolheim; Hans Loser, Langenau; Klaus Lehleiter, Mengen, all of Germany

[73] Assignee: Voith Sulzer Papiermaschinen GmbH, Heidenheim, Germany

[21] Appl. No.: 09/136,399

[22] Filed: Aug. 19, 1998

[30] Foreign Application Priority Data

Aug. 20, 1997 [DE] Germany ..... 197 36 048

[51] Int. Cl.[7] ..... D21F 11/00

[52] U.S. Cl. ..... 162/198; 162/252

[58] Field of Search ..... 162/198, 202, 162/203, 215, 216, 252, 254, 258, 259, 262, 263, 289, 298, 299, 336, 343, DIG. 10, DIG. 11

[56] References Cited

U.S. PATENT DOCUMENTS

| | | | |
|---|---|---|---|
| 4,019,819 | 4/1977 | Lodzinski | 356/73 |
| 5,707,495 | 1/1998 | Heinzmann et al. . | |
| 5,885,420 | 3/1999 | Heinzmann et al. . | |

FOREIGN PATENT DOCUMENTS

| | | |
|---|---|---|
| 2432836 | 1/1975 | Germany . |
| 2708390 | 9/1977 | Germany . |
| 3535849 | 4/1987 | Germany . |
| 4000363 | 5/1990 | Germany . |
| 4019593 | 1/1992 | Germany . |
| 4112347 | 10/1992 | Germany . |
| 4239845 | 5/1993 | Germany . |
| 4211290 | 10/1993 | Germany . |
| 4211291 | 10/1993 | Germany . |
| 4316054 | 10/1993 | Germany . |
| 4239270 | 5/1994 | Germany . |
| 19634996 | 3/1998 | Germany . |
| 19634997 | 3/1998 | Germany . |

OTHER PUBLICATIONS

Kiessling, "Anforderungen an den Stoffauflauf zur Flächengewichts–Querprofilregelung," *Wochenblatt für Papierfabrikation*, 22, pp. 967–972 (1988).

*Primary Examiner*—Stanley S. Silverman
*Assistant Examiner*—Robert McBride
*Attorney, Agent, or Firm*—Greenblum & Bernstein, P.L.C.

[57] ABSTRACT

An apparatus and a process for controlling or regulating a web property profile of a paper or cardboard web produced in the manufacturing process of a paper or cardboard machine is disclosed. The apparatus incorporates information regarding the position of one or more devices of a plurality of adjustable devices for sectionally manipulating at least one web property for regulating or controlling the devices to manipulate at least one web property across the width of the machine. The process includes combing the regulating process or a regulator device for adjusting individual actuators that only act on a certain section of conventional systems with the adjustment of an actuator acting across the entire web width for achieving a certain web property, so that the sectionally-operating actuators are not located in an end-position, so that these sectional actuators continue to be able to adjust the web property.

15 Claims, 5 Drawing Sheets

APPARATUS AND PROCESS FOR CONTROLLING OR REGULATING A WEB PROPERTY PROFILE

CROSS-REFERENCE TO RELATED APPLICATION

The present invention claims the priority under 35 U.S.C. 119 of German Patent Application No. 197 36 048.3 filed on Aug. 20, 1997, the disclosure of which is expressly incorporated by reference herein in its entirety.

BACKGROUND OF THE INVENTION

1. Field of the Invention

The invention relates to an apparatus for controlling or regulating a web property profile of a paper or cardboard web in the manufacturing process of a paper or cardboard web manufacturing machine, and to a process for controlling or regulating a web property profile of a paper or cardboard web in the manufacturing process of a paper or cardboard web manufacturing machine.

2. Discussion of Background Information

Many interfering factors occur in the production of a paper or cardboard web during the manufacturing process, which can negatively impact the web properties of the paper or cardboard web with respect to its uniformity across the machine width as well as with respect to its stability during the manufacturing process. Temperature variations, pressure variations, work tolerances, and errors in the construction or the adjustment of the paper or cardboard manufacturing machine during the manufacturing process are, for example, some of these interfering factors. The main web properties which influence the quality of the produced paper or cardboard are the mass per unit area, the fiber orientation, and formation. However, properties such as ash content, opacity, moisture content, web thickness, and roughness of the web play a significant role as the quality criteria of a paper or cardboard web. In general one tries to keep the above-mentioned web properties as uniform and constant as possible across the entire width and over the entire length of the web.

Patent document DE 35 35 849 suggests changing the width of outlet opening of a headbox at certain locations of the web width such that, correspondingly, the throughput of the material suspension is changed locally. If the throughput of the material suspension changes locally with a concentration that is uniform across the machine width, it will have an effect on the amount of solid matter deposited at this location of the web. Thus, an adjustment of the mass per unit area cross-sectional profile can be attained.

Another patent document DE 40 19 593, discloses a device and a process for regulating the weight per unit area profile of the web surface. The concentration of the material suspension flow here is to be changed at a particular location of the web width if the weight per unit area profile of the paper or cardboard web deviates. In order to achieve this, it is suggested that the headbox be sectioned at least partially across the machine width and that it is fed with the assistance of individually controlled sectional flows exhibiting individually adjustable concentrations. The individual concentration adjustment of each respective sectional flow occurs by regulating the feed proportions of two individual flows with a constant but different concentration. Due to the different sectional flow compositions with respect to fibrous material, ash, and other additives, a change in the weight per unit area results in the corresponding location of the web width.

In the control process, the weight per unit area cross-sectional profile of the paper or cardboard web is measured at the end of the paper or cardboard machine and the feed flow proportions of the two individual flows of different concentration, which form the respective sectional flow, are regulated with a control loop such that the most uniform weight per unit area cross-sectional profile is provided.

A similar control/regulator device, as well as a process to regulate the weight per unit area cross-section and the fiber-orientation cross-sectional profile is known from the patent document DE 42 39 845. This document, likewise, proposes to construct the headbox at least partially in sections and to control the paper or cardboard material suspension in the individual sections with respect to its consistency and/or fiber orientation by admixing diluting water or other fluids in order to regulate the respective cross-sectional profile. A similar sectional headbox is known from the patent document DE 43 16 054.

Patent document DE 196 34 997 describes a control device with several measuring sensors and a process to regulate different web property profiles. Likewise, patent document DE 196 34 996 discloses a headbox that regulates the pulp density with a paper or cardboard pulp consistency regulator.

In patent documents DE 42 11 291 and DE 42 11 290, a sectional consistency regulator of a headbox is depicted, exhibiting a single valve for each section with a constant volumetric flow. In the patent documents DE 40 19 593 and DE 41 12 347, a material consistency regulator and volumetric flow regulator for a sectioned headbox, each exhibiting two valves, is shown.

The disclosure of each of the foregoing patent documents is expressly incorporated by reference herein in their entirety.

SUMMARY OF THE INVENTION

A major problem of the above-mentioned regulators, control devices, and processes of the above-cited patent documents is that under unfavorable conditions, individual actuators or final control elements, such as valves for regulating the material concentration or material consistency or adjusting devices on the headbox shutter, can be located in an end-position. If, in such a situation, another control command, exceeding the end-position of the actuator, is sent to the corresponding actuator, this command cannot be executed. Thus, no desired adjustment of the web property occurs at the corresponding location of the profile, although the process control system has recognized the necessity for a corresponding change, thus locking the control system.

Such an end-position of an actuator can, for example, be that a valve of a diluting water feed line of a mixer is either at maximum open or closed position and thus no adjustment of the material concentration of the corresponding section is possible. It can, however, also be that the shutter opening for a shutter of the headbox is set at a maximum but a larger opening is required, which can not be achieved. These situations have the result that the web property cross-sectional profile cannot be improved by the regulator device and thus considerable losses in quality have to be reckoned with during the manufacturing process.

The task of the invention is to improve the known regulator device such that the above-mentioned jam of the regulating system is eliminated. Furthermore, a corresponding process for controlling or regulating a web property profile is provided.

In accordance with a first feature of the invention, a device for controlling or regulating a web property profile of a paper or cardboard web in the manufacturing process of a paper or cardboard machine web includes at least one adjustable means for controlling at least one web property across the machine width, a large number of adjustable devices for sectionally manipulating at least one web property, at least one device for directly or indirectly measuring the cross-sectional profile, and at least one device for controlling or regulating the large number of adjustable devices to sectionally control at least one cross-sectional profile of at least one web property, such that a device is provided for including the information regarding the position of a device or several devices of the large number of adjustable devices for sectionally manipulating at least one web property for regulating or controlling the devices for manipulating at least one web property across the machine width.

In accordance with a feature of the process, it is suggested that a control or regulating process for a web property profile of a paper or cardboard web be designed into the manufacturing process of a paper or cardboard manufacturing machine such that at least one profile of a web property is measured, the measuring signals are fed into a computer unit which is required for calculating the necessary correction to achieve the desired profile of this web property, and upon which, as a result of the calculation, an adjustment of at least one actuator is implemented, if needed, for sectionally controlling the web property. In addition, the position of at least one actuator or several actuators of a large number of the actuators for sectionally controlling the web property is determined, the position of the actuators is processed in a computer unit in order to calculate a correction of one or more actuators for controlling the web property across the machine width, and to thereafter execute a correction of the web property by adjusting an actuator or actuators for controlling this web property across the machine width.

For a control process or in a control device, a concept of the invention includes an overlapping of the situation known to date of adjusting individual actuators, affecting only a certain section, with adjusting an actuator affecting the entire web width with respect to a particular web property, such that the sectionally operating actuators are not located in an end-position, and so that the web property can continue to be adjusted with these sectional actuators.

A possible criterion for adjusting the actuator affecting the web property across the machine width could, for example, be the deviation of the mean value of the sectional actuators from their average settings. Another advantageous criterion for executing a process on the web property across the machine width could include the actuator being positioned in its maximum or minimum position from its end position, respectively. The goal of a correction by the actuator acting across the machine width then lies in bringing the actuator positioned at a maximum distance and the actuator positioned at a minimum as close as possible towards each other.

In place of the position of the actuators, a certain, measured pulp suspension property at the exit of a mixer or another end result affected by the position of an actuator acting sectionally can, for example, also be used as control variable. Likewise, a web property which correlates directly or indirectly to the position of the actuator can also serve as a control variable. Another possibility of attaining the information regarding the position of the sectionally operating actuator can occur by a simple calculation of the control command history to the individual actuators.

A feature of the invention is an apparatus for controlling/regulating a web property profile of a paper or cardboard web including at least one adjustable element provided to manipulate at least one property of the web across a width of the machine, a plurality of adjustable components for sectionally manipulation of at least one web property, at least one measuring element for measuring a cross sectional profile of the one web property, at least one controller for controlling the plurality of adjustable components for the sectional manipulation of at least one cross directional profile of the at least one web property, and a collector provided for incorporating information about a position of at least one of the plurality of adjustable components for the sectional manipulation of at least one web property into the control of the at least one adjustable element manipulating the at least one web property.

Another feature is that the plurality of adjustable components are final control components of a pulp headbox shutter.

Another feature is that the plurality of adjustable components for the sectional manipulation of the at least one web property are final control components of a mixer of a headbox regulated sectionally with regards to at least one of consistency and volumetric flow of a pulp suspension.

A further feature is that the plurality of adjustable components are final control components of a regulating system of a sectional feed system which feed fluid into a pulp suspension.

An additional feature is that the measuring element for the measurement of the cross sectional profile is a measuring frame extending perpendicular across the machine width.

Another aspect is that the measuring element is positioned between a drying section of the machine and a take-up of the paper or cardboard web.

A further aspect of the invention is that the measuring element is positioned in an outlet region of a headbox.

Another feature is that the measuring element is positioned adjacent a wet section or a drying section of the machine.

Another feature of the invention is that at least one controller for the sectional manipulation of at least one cross-sectional profile of at least one web property is a process control system.

A further feature is that the collector for incorporating the information about the position of at least one of the actuators for sectionally manipulating at least one web property includes one of a program and a program module to control the components for controlling at least one web property and correlates an actual position of the adjustable components with commands to the controller for controlling the plurality of adjustable components.

Another aspect of the invention is that the information of the position of the components of the plurality of adjustable components for the sectional control of at least one web property is obtained by a measuring system measuring the position of the adjustable component for the sectional control of the cross-direction profile of the web property and a current position of the adjustable components with respect to sectional influence of at least one cross-sectional profile and transmits the information regarding the position via a return line to the process control system.

Another aspect is that at least one of the adjustable elements for manipulating at least one web property is one of a pump and a throttle valve positioned in one of a high and low concentration line to a headbox.

Still another aspect is that at least one adjustable parameter for manipulating a web property is concentration of a pulp suspension in one of a high and low concentration line feeding into a headbox of the machine.

Other features of the invention include that at least one of a measured and manipulated web property can be the weight per unit area, formation, ash content, thickness, moisture content, opacity, roughness, and fiber orientation of the web.

Another feature of the invention is a process for controlling a web property profile of a paper or cardboard web in the manufacturing process of a paper or cardboard manufacturing machine, including measuring at least one profile of a web property, processing measured signals corresponding to the measuring of the at least one profile of the web in a computer unit for calculating a correction to achieve a desired profile of the web property, adjusting at least one actuator sectionally manipulating the web property on the basis of calculated correction values, determining a position of at least one of the actuators of a plurality of actuators for sectionally controlling the web property, processing the position of at least one of the actuators in a computer unit for calculating a correction of at least one actuator to manipulate the web property across the machine width and correcting the web property by adjusting at least one actuator to affect the web property across the width of the machine.

Another feature is the at least one actuator for the sectional manipulation of the web property is moved at least approximately in opposite directions at the same time as another of the actuators for manipulating the web property across the machine width.

Another feature resides in that the position of at least one actuator for the sectional manipulation of the web property is calculated from a previous control command history of the computer unit.

A further feature is that the position of at least one actuator is measured at a position of an actuator from among the plurality of the actuators.

Another aspect of the invention is that weight per unit area is a measured web property. Other features of the measured web property may be used, such as web formation, ash content, web thickness, moisture content, web opacity, surface roughness of the web, and fiber orientation of the web.

Another feature of the process is that the position of as least one actuation for the sectional manipulation of the web property is calculated from previous control command history of the computer unit.

A further feature is that the correction of the web property is executed by adjusting at least one of the actuators so that after recovery of the actuator, the actuator is spaced from an end position of the headbox.

Yet another aspect of the invention is that an average value of the position of the actuators for the sectional manipulation is used for calculating a magnitude of the correction for the adjustment to an actuator of the plurality of actuators.

BRIEF DESCRIPTION OF THE DRAWINGS

The present invention is further described in the detailed description which follows, in reference to the noted drawings by way of non-limiting examples of preferred embodiments of the present invention, wherein the same reference numerals represent similar parts throughout the several views of the drawings, and wherein.

DETAILED DESCRIPTION OF THE INVENTION

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
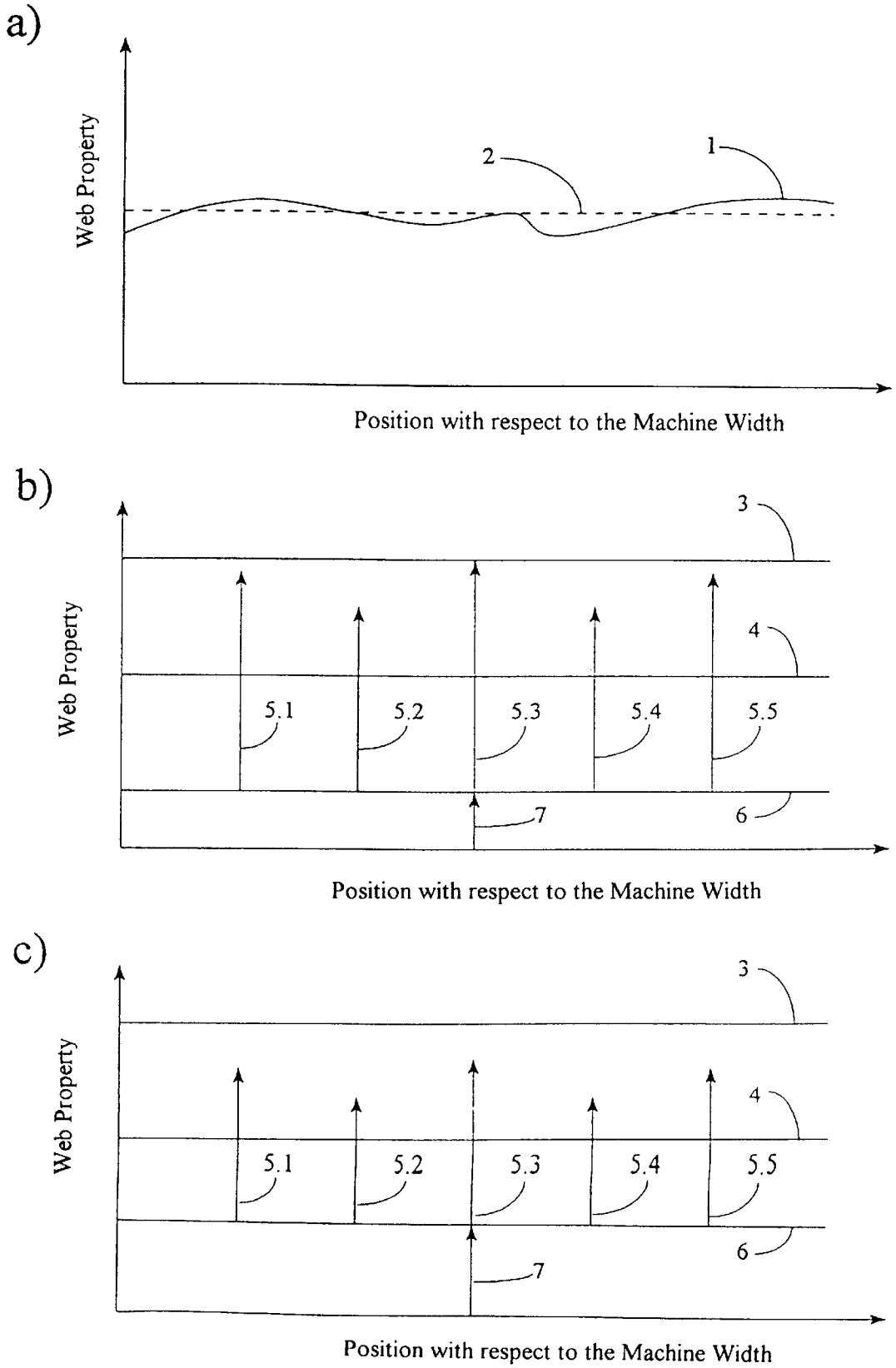
FIG. 1*a* depicts a web property cross-section with the abscissa showing the web position with respect to the machine width and the ordinate showing values of the web property.
FIG. 1*b* depicts a final control state of selected actuators across the web width, the abscissa showing the position with respect to the machine width and the ordinate showing a current adjustment of each actuator.
FIG. 1*c* depicts adjustment of a final control element position of actuators acting across the entire web width.

In FIG. 1, a graphic depiction of a control situation in accordance with the invention is shown. FIG. 1*a* particularly depicts a web property cross-section. On the abscissa, the position with respect to the machine width is plotted. The ordinate shows the values of the web property. It can, for example, deal with surface weight, ash content, web thickness, or other web properties stated above.

The progression of the actual web property is depicted by curve 1, while the dashed line 2 depicts the ideal target-value of this web property. The progression of the web property, depicted by the curve 1 shows the deviations of the web property from the web property profile as they occur in normal operation. That is, the corrections for the given actuators for optimizing the web property profile have already been undertaken as far as possible.

In FIG. 1*b*, the actual final control element state of five selected actuators units across the web width is depicted. On the abscissa, the position with respect to the machine width is again plotted and the ordinate shows a measure for the current adjustment of each actuator. The lines 3 and 4 show the maximum or minimum end-position of the respective actuators. The arrows 5.1 through 5.5 show the respective adjustment state of the individual actuators, whereby only the length of the arrows—that is the distance of the arrow point from the baseline 6—depicts the adjustment position of the final control element. In the display of the momentary state of the actuators, it can be seen that all actuators are located in the upper half of their adjustment range between the lines 3 and 4, whereby the actuator 5.3 has attained a maximum position.

In addition to the positions of the sectional actuators 5.1 through 5.5, the actuator 7 which is responsible for adjusting the web property across the machine width is depicted in the current position at that time, which again indicates the baseline 6 for the sectional actuators 5.1 through 5.5.

In accordance with the invention, an adjustment of the final control element position of the actuator acting across the entire web width is triggered by a triggering event, causing a parallel displacement of all sectional actuators at positions 5.1 through 5.5.

This event is depicted in FIG. 1*c*. Here, the control variable of the actuator 7 is reduced so that the basis for the sectional actuators 5.1 through 5.5 is raised, whereby the individual control variables 5.1 through 5.5 are reduced after a respective transient recovery phase, after which they are again located in the middle control region. In this control range, it is again possible to optimally control the sectional actuators.

The key trigger event for the adjustment of the actuator acting across the machine width can, for example, be the sectionally acting actuator reaching an end position. Likewise, however, a continuous regulation of the actuator acting across the machine width can ensue in such a manner that the control mechanism attempts to create a maximum distance from the maximum or minimum positions of the sectionally acting actuators. This is an advantage insofar as the linear control region of an actuator is generally found in the middle control range, thereby simplifying the control behavior of the entire system.

Figure 2:
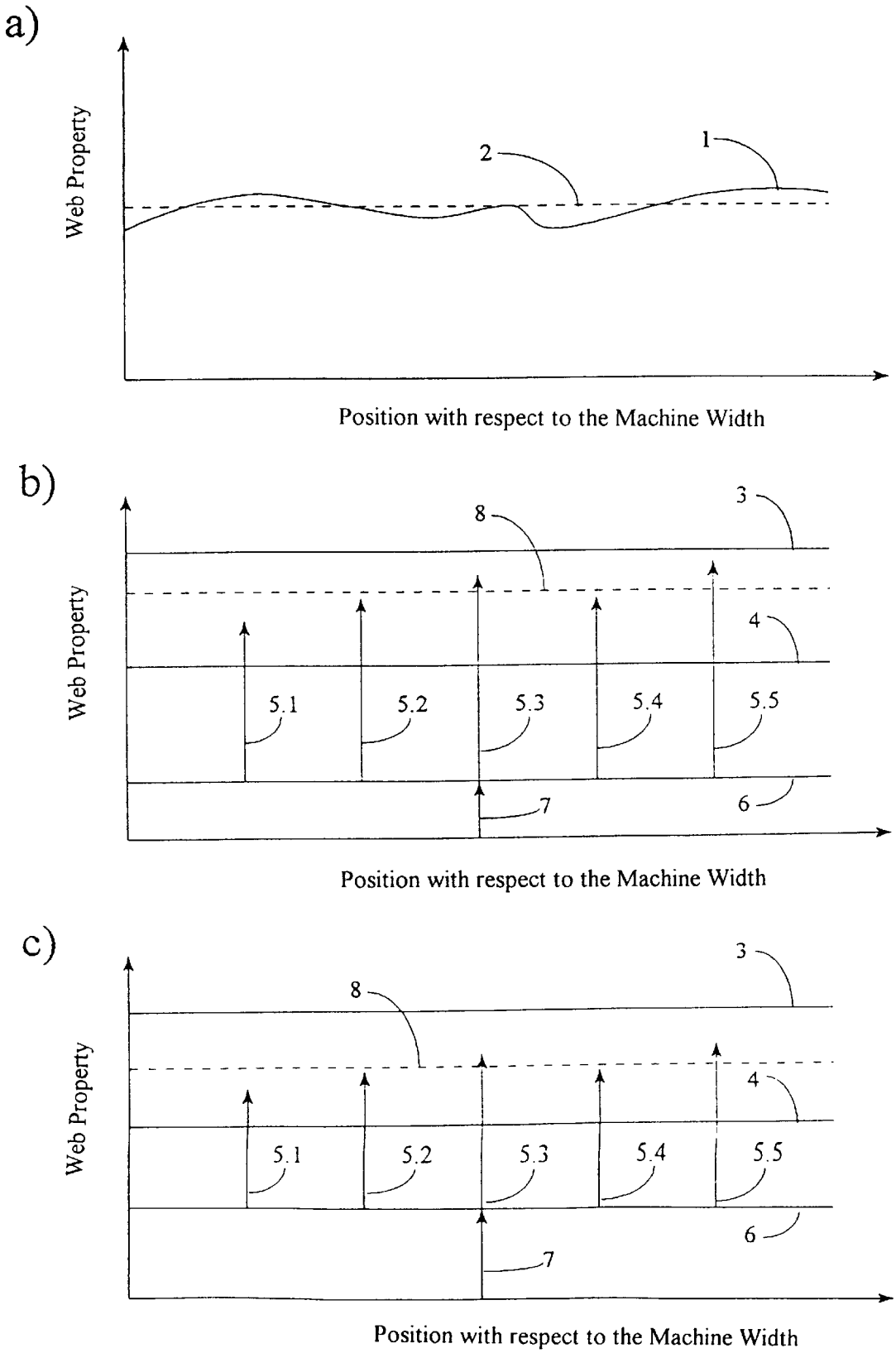
FIG. 2*a* depicts a situation identical to FIG. 1 as reference.
FIG. 2*b* depicts a mean value of the sum of all actuator positions.
FIG. 2*c* depicts the mean value of the line 8 deviates from a center position between maximum and minimum adjustment.

In FIG. 2, a situation similar to that of FIG. 1 is depicted. FIG. 2*a* is identical to FIG. 1*a*. In FIG. 2*b*, the mean value 8 of the sum of all actuator positions 5.1 through 5.5 is also given. It can be seen from the situation displayed in FIG. 2*c* that the mean value depicted by the line 8 deviates in this situation from the center position between a maximum adjustment 3 and the minimum adjustment 4.

This deviation or a certain, pre-set variable of the deviation can be viewed as the triggering event for the adjustment of the actuator acting across the machine width. If the actuator acting across the machine width is controlled appropriately with regards to its variable, the mean value of the individual sectionally acting actuators 5.1 through 5.5 again wanders into the middle range between the maximum adjustment 3 and the minimum adjustment 4 of the sectionally acting actuators.

In accordance with the invention, it is possible to execute the return movement of the sectional actuators after an adjustment of the actuator acting across the web width via the normal control paths. This, however, as a result of the relatively long run time of the paper or cardboard web within a paper or cardboard machine until the web property in question is measured, requires a long run time.

A more preferred situation with advantages if, simultaneous to the adjustment of the actuator acting across the web width for a certain web property, a command from the regulator system is given simultaneously and uniformly across the machine width so as to steer all sectionally acting actuators in the opposite direction. This steering in the opposite direction by all sectionally working actuators should thereby produce a large effect, but is set in the opposite direction, to adjust the actuator acting across the machine width. This only causes deviations from the target value of the overall profile ranging from minimal to none at all. In addition, the transient recovery period to an optimal regulating state is reduced considerably.

Figure 3:
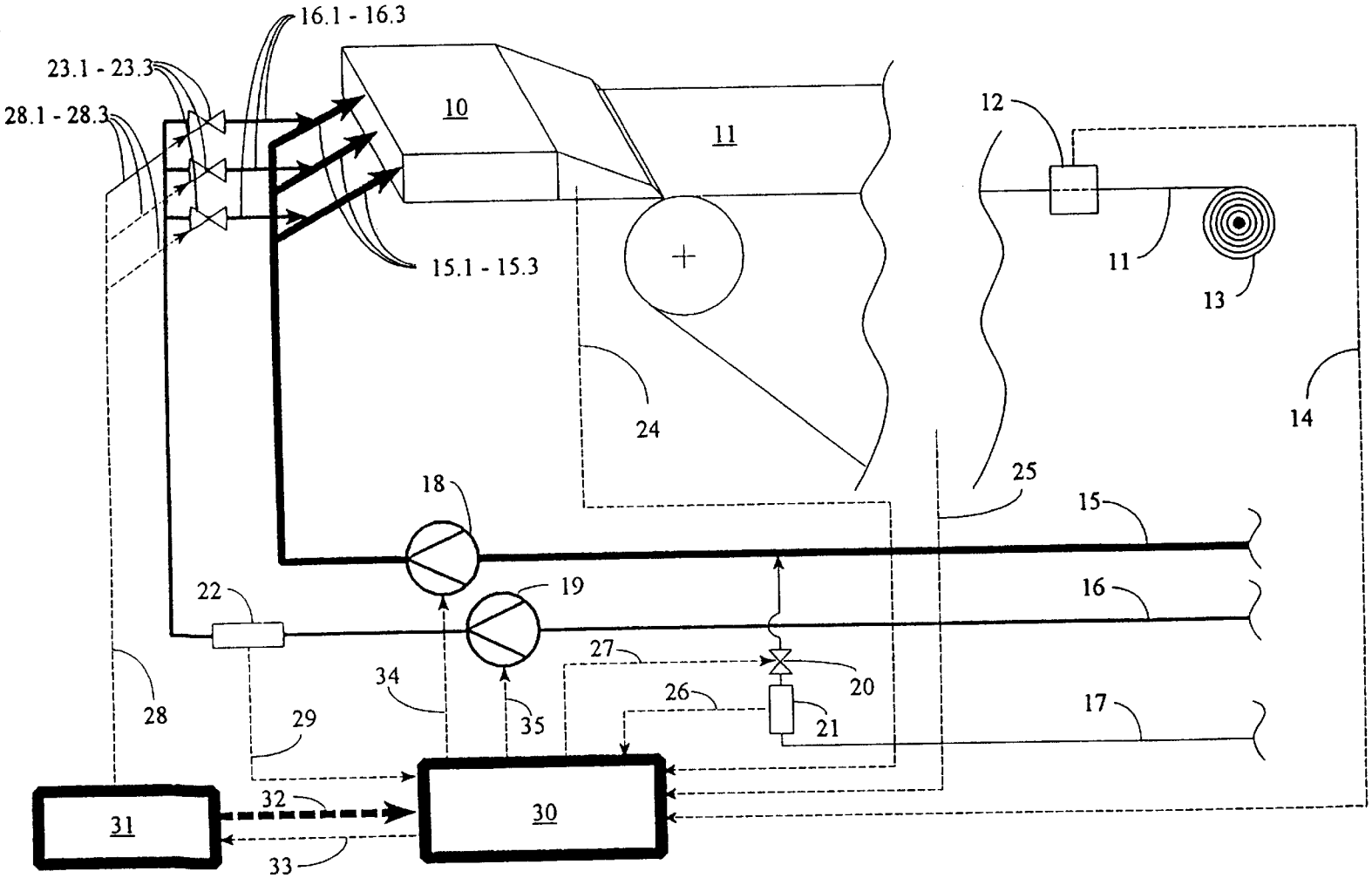
FIG. 3 is a schematic depiction of a control device in accordance with the invention with a weight per unit area control exhibiting a diluting feed in the high-concentration line.

In FIG. 3, a control device is depicted in accordance with the invention for a weight per unit area regulation with the aid of a headbox that is pulp-density-regulated. The headbox 10, regulated with respect to pulp density, receives the material suspension with a high concentration $C_H$, which is supplied via a high-concentrate line 15 which is pressurized via a regulated pump 18 and divided, before entry into the headbox, into individual sectional flows 15.1, 15.2. In this illustration, for reasons of clarity, only three partial flows are depicted. However, under real-life conditions, the number of material headbox sections is significantly greater. Before entering the headbox, the individual sectional flows 15.1 through 15.3 are supplied with individual diluting flows 16.1 through 16.3 which are regulated with respect to volumetric flow and exhibit a low concentration $C_L$. The volumetric flow regulation of the sectional diluting flows 16.1 through 16.3 occurs with the aid of throttle devices 23.1 through 23.3, which act as sectional actuators. The adjustment of the sectional actuators occurs via the control lines 28.1–28.3, which are operated with the aid of a corresponding computer unit 31.

In the illustrated embodiment, it is assumed that a mixer, as disclosed in patent documents DE 42 11 291 or DE 42 11 290 is used at the point in which the individual mixing flows of a higher and a lower concentration merge. In this case, it is sufficient to use a valve for each section to obtain a constant, sectional overall volume flow, respectively. However, it is also within the scope of the invention to effect the control of the overall sectional volume flows with the aid of two interacting throttle devices. The latter operation is, for example, depicted in patent documents DE 40 19 593 and DE 41 12 347.

The headbox 10 transfers its pulp suspension as a layer across the width of the machine onto a sieve or screen 12, on which a fibrous web is formed in the continuation of the web manufacturing machine, wherein it is drained intensely and dried, and at the end of the machine wound onto a roll 15. Prior to the take-up onto the roll 15, the weight per unit area cross-sectional profile of the paper or cardboard web is measured via a measuring frame 12 and the measurement is transmitted via the line 14 to the process control system with its computer unit. The computer unit of the process control system 30 calculates the necessary adjustment of the sectional actuators, in this case the throttle devices 23.1 through 23.3, using the measured cross-sectional profile, and forwards this information via the line 33 to the computer unit 31, from which the adjustment of the actuators 23.1 through 23.3 is initiated via the overall control line 28, which is divided into the individual control lines 28.1–28.3. It is also within the scope of the invention to actuate the individual final control elements via a bus system.

The process control system 30 receives the information about the consistency of the material suspension in the headbox in the measuring section 24 and/or information about the retention behavior over the measured section 25 via one or more measuring locations. The process control system 30 furthermore controls the large suspension flows via the pumps 18 and 19 in the supply lines 15 and 16 of the headbox. For a more precise adjustment of the pulp suspension supply, a flowmeter 22 can be provided in the diluting flow, as in the present example; likewise, a flowmeter can be used for all flow-rate measuring systems in the control system.

In accordance with the invention, information about the position of the throttle devices 23.1 through 23.3 is now delivered to the process control system 30 via another data line 32. This information can either be calculated as shown or produced with the aid of corresponding measuring devices directly at the actuators of the throttle devices 23.1 through 23.3. On the basis of the calculated position of the sectional throttle devices 23.1 through 23.3, the process control system calculates a necessary change in the concentration of the dense pulp suspension in the line 15 and opens or closes an actuator acting across the machine width. In this case, it is the throttle valve 20 supplying additional diluting fluid via the supply line 17 to the high-concentrate line 15. The supply line 17 supplies either fresh water or diluting water, with which the concentration of the dense pulp suspension can be changed. Through this adjustment, a machine-wide increase or decrease of the concentration of the material suspension is triggered, whereby the position of the actuators 23.1 through 23.3 can again be moved near the desired normal position. In accordance with the invention, this can occur via the normal control section by measuring the result at the measuring frame 12. However, it is also possible to calculate the necessary control data in advance and accordingly, to cause a simultaneous adjustment of the sectional actuators 23.1 through 23.3. For a more precise metering of the flow of the diluting fluid, supplied via the line 17, a flowmeter 21 is provided, which is connected to the process control system 30 with the aid of the line 26.

Figure 4:
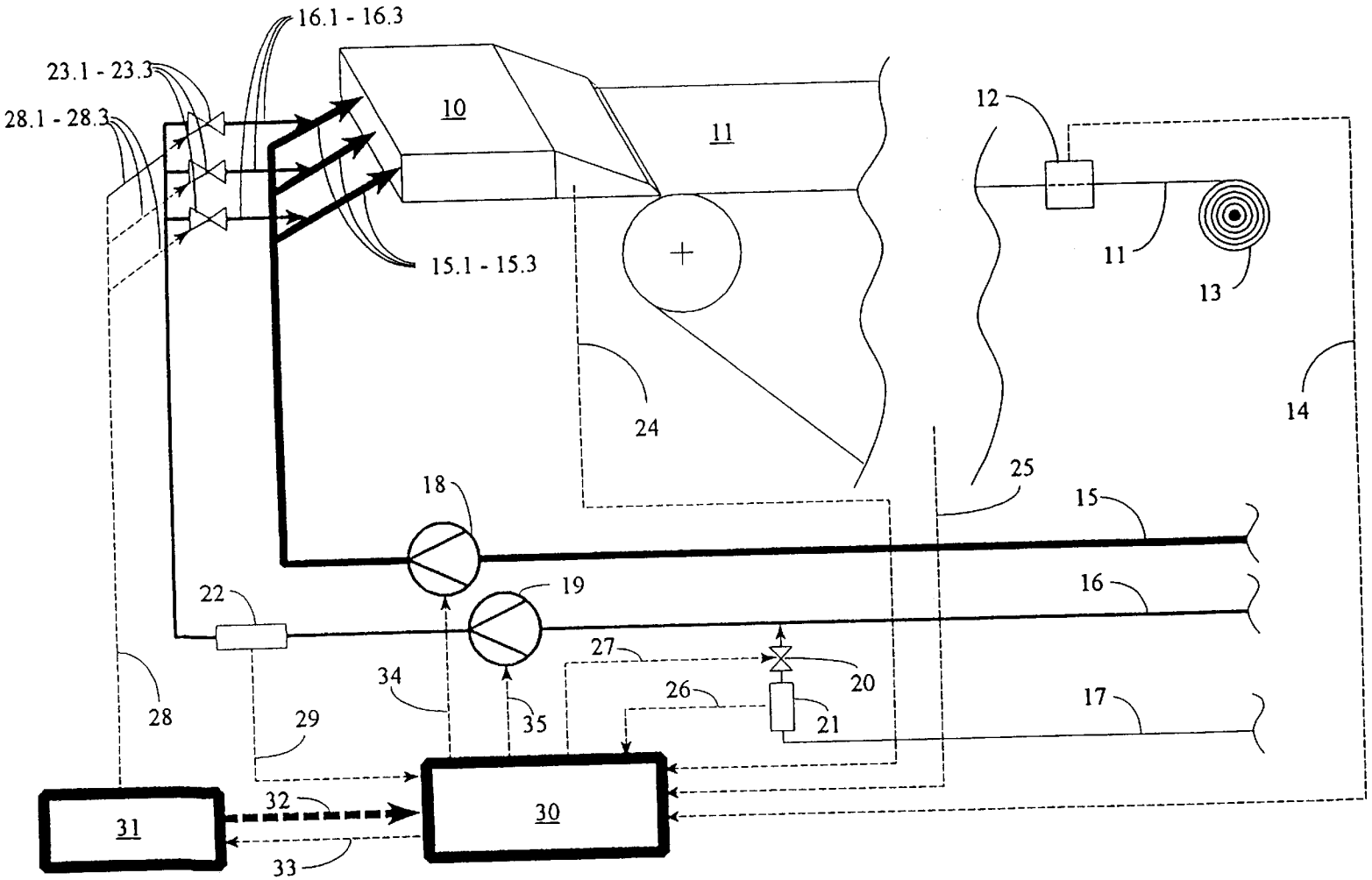
FIG. 4 is a schematic depiction of a control device in accordance with the invention with a weight per unit area control exhibiting a diluting feed in the low-concentration line; and, FIG. 5 is a schematic depiction of a control device in accordance with the invention with a weight per unit area control exhibiting a cross-connection between the high and low concentration line.

Another alternative for the embodiment in accordance with the invention can be a control system, wherein the feed line 17 is connected with fresh water or clean sieve water and the feed line 16 of the low-concentrate supply. This embodiment is depicted in FIG. 4.

Figure 5:
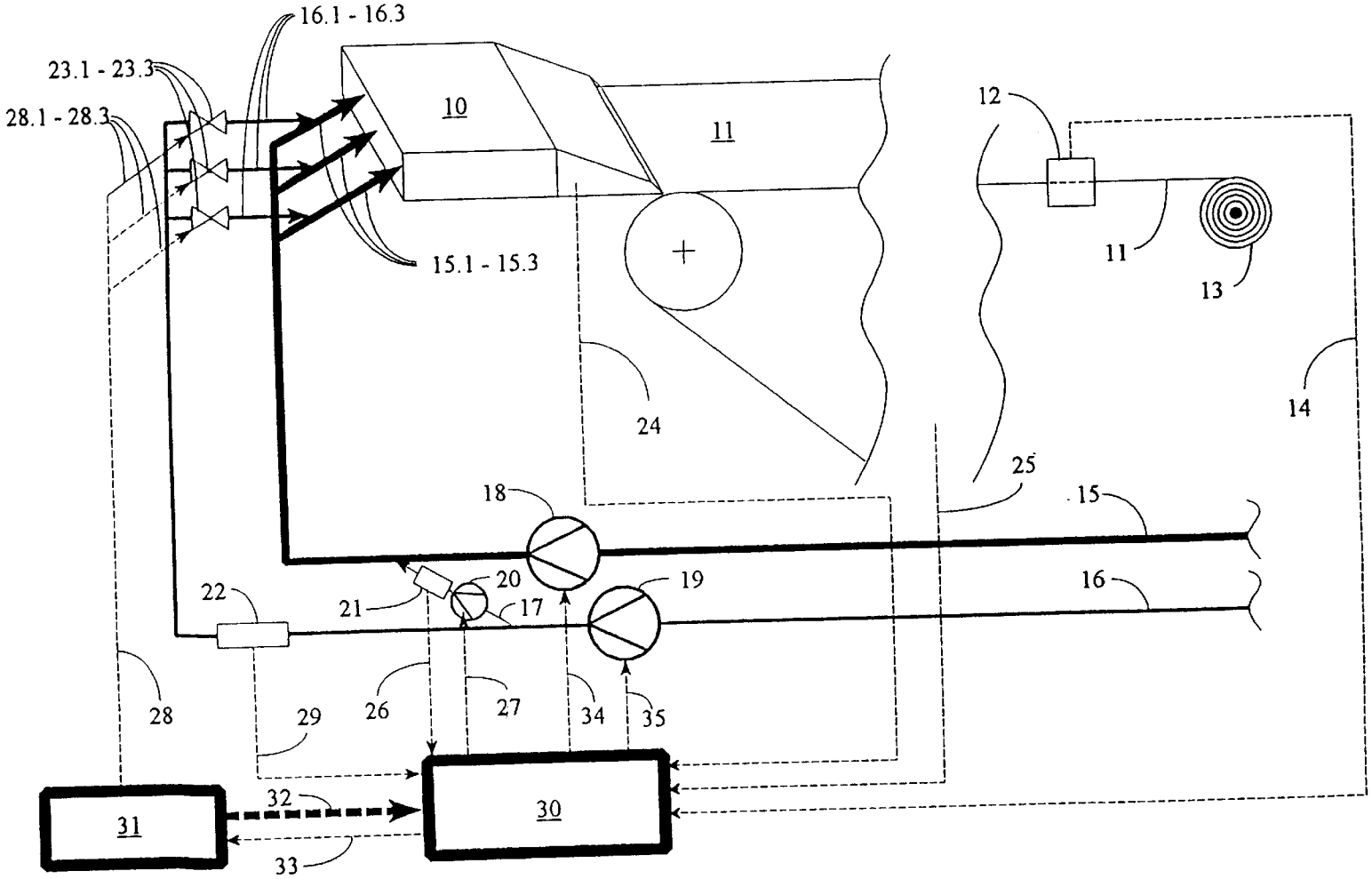

Another possibility for regulating the material density across the machine width in the supply lines of the high-concentrate and/or low concentrate lines 15, 16 leading to the headbox can include connecting these two supply lines to one another via another transport line 17. If, now, the concentration in the high-concentrate line 15 needs to be reduced, the amount of the suspension fed from the low-concentrate line 16 to the high-concentrate line 15 is increased or, in the reverse case, reduced. This can, for example, occur with the aid of a speed-controlled pump 20 connected to a flowmeter 21. Such an embodiment is shown in FIG. 5. FIGS. 3, 4, and 5 describe measures by which the consistency in the lines 15 ($Q_H$) and 16 ($Q_L$) can be changed.

It can also be practical to change the proportion of $Q_L/Q_H$, without supplying additional sieve water (line 17) by, for example, using the pumps 18 and 19 to regulate the proportions.

With all shown embodiments, it is possible to obtain considerably better results in regulating the headbox of a paper or cardboard web manufacturing machine and to therefore improve the overall paper or cardboard quality that can be achieved with the present invention.

It is noted that the foregoing examples have been provided merely for the purposes of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

REFERENCE LIST

| | |
|---|---|
| 1 | Web property profile |
| 2 | Target value |
| 3 | Maximum position of the actuators |
| 4 | Maximum position of the actuators |
| 5.1, 5.2, 5.3, 5.4, 5.5 | Position of the sectionally-working actuators |
| 6 | Baseline |
| 7 | Position of the actuator acting across the machine width |
| 8 | Average value of the actuator position |
| 10 | Head box |
| 11 | Sieve |
| 12 | Measuring frame |
| 13 | Roll |
| 14 | Measuring line |
| 15 | High-concentrate line |
| 15.1, 15.2, 15.3 | Sectional flows |
| 16.1, 16.2, 16.3 | Low-concentrate line |
| 17 | Supply line |
| 18, 19 | Pumps |
| 20 | Throttle valve or pump |
| 21, 22 | Flowmeter |
| 23.1, 23.2, 23.3 | Throttle devices |
| 24 | Connection line |
| 25 | Data line |
| 26 | Measuring line |
| 28 | Control line |
| 30 | Process control system |
| 31 | Computer unit |
| 32 | Data line |

What is claimed is:

1. A process for controlling/regulating a web property profile of a paper or cardboard web in the manufacturing process of a paper or cardboard web manufacturing machine, comprising:

measuring at least one profile of a web property;

processing measured signals corresponding to the measuring of the at least one profile of the web in a computer unit and calculating a correction value to achieve a desired profile of the web property;

adjusting at least one first actuator adapted to sectionally manipulate the web property based upon the calculated correction values;

determining a position of the at least one first actuator;

processing the determined position of the at least one first actuator in the computer unit and calculating a correction for at least one second actuator adapted to manipulate the web property across a machine width; and correcting the web property by adjusting the at least one second actuator based upon the calculated correction for said at least one second actuator.

2. The process in accordance with claim 1, wherein the at least one first actuator is moved at least approximately in an opposite direction at the same time the at least one second actuator.

3. The process in accordance with claim 1, wherein the determined position of the at least one first actuator is calculated from a previous control command history of the computer unit.

4. The process in accordance with claim 1, wherein the determined position of the at least one first actuator is measured at an actuator of a plurality of first actuators.

5. The process in accordance with claim 1, wherein weight per unit area is the measured web property.

6. The process in accordance with claim 1, wherein formation of the web is the measured web property.

7. The process in accordance with claim 1, wherein ash content is the measured web property.

8. The process in accordance with claim 1, wherein web thickness is the measured web property.

9. The process in accordance with claim 1, wherein moisture content of the web is the measured web property.

10. The process in accordance with claim 1, wherein opacity of the web is the measured web property.

11. The process in accordance with claim 1, wherein surface roughness of the web is the measured web property.

12. The process in accordance with claim 1, wherein fiber orientation of the web is the measured web property.

13. The process in accordance with claim 5, wherein the determined position of the at least one actuator is calculated from a previous control command history of the computer unit.

14. The process in accordance with claim 1, wherein the correction of the web property is executed by adjusting the at least one second actuator, such that after recovery of the at least one first actuator, the at least one second actuator is spaced from an end position of a headbox of the machine.

15. The process in accordance with claim 1, wherein an average value of the determined position of the at least one first actuator is used for calculating a magnitude of the correction for the adjustment to the at least one second actuator.

* * * * *